US005317907A

United States Patent [19]

Shimizu et al.

[11] Patent Number: 5,317,907

[45] Date of Patent: Jun. 7, 1994

[54] AIR CONDITIONING APPARATUS HAVING AMBIENT AIR-CONDITIONING UNIT AND A PLURALITY OF PERSONAL AIR-CONDITIONING UNITS CONNECTED TO OUTDOOR UNIT

[75] Inventors: Keiichiro Shimizu, Fujinomiya; Eiji Kuwahara, Fuji; Manabu Kitamoto, Shizuoka; Masao Amano, Shizuoka; Yasunori Ichikawa, Fuji; Masayuki Hibi, Fujinomiya; Keizo Iwata, Fuji, all of Japan

[73] Assignee: Kabushiki Kaisha Toshiba, Kawasaki, Japan

[21] Appl. No.: 873,187

[22] Filed: Apr. 24, 1992

[30] Foreign Application Priority Data

Apr. 25, 1991 [JP] Japan ..... 3-95602

[51] Int. Cl.[5] ..... F25B 49/00

[52] U.S. Cl. ..... 62/176.6; 62/95; 62/261; 62/440

[58] Field of Search ..... 62/176.6, 525, 283, 62/217, DIG. 16, 261, 95

[56] References Cited

U.S. PATENT DOCUMENTS

| | | | |
|---|---|---|---|
| 3,316,731 | 5/1967 | Quick | 62/217 X |
| 3,645,109 | 2/1972 | Quick | 62/278 X |
| 4,813,474 | 3/1989 | Umezu | 165/21 |
| 4,926,652 | 5/1990 | Kitamoto | 62/175 |

FOREIGN PATENT DOCUMENTS

| | | | |
|---|---|---|---|
| 0200918 | 6/1983 | German Democratic Rep. | 62/217 |
| 1203856 | 8/1989 | Japan . | |
| 2302532 | 12/1990 | Japan . | |
| 421459 | 12/1934 | United Kingdom . | |
| 2249168 | 4/1992 | United Kingdom . | |

*Primary Examiner*—William E. Wayner

*Attorney, Agent, or Firm*—Cushman, Darby & Cushman

[57] ABSTRACT

In an air conditioning apparatus, the refrigerant discharged from a compressor of an outdoor unit is passed through an outdoor heat exchanger, the refrigerant having passed through the outdoor heat exchanger is passed through an indoor heat exchanger of an ambient air-conditioning unit and the refrigerant having passed through the indoor heat exchanger is returned to the compressor to cool the whole space in the room. At the same time, the refrigerant discharged from the compressor is passed through the outdoor heat exchanger, the refrigerant having passed through the outdoor heat exchanger is passed through indoor heat exchangers of a plurality of personal air-conditioning units and the refrigerant having passed through the indoor heat exchangers is returned to the compressor to separately cool the discrete spaces in the room. At the time of cooling, the processes for the sensible heat load and latent heat load are effected in the in the indoor heat exchanger of the ambient air-conditioning unit and only the process for the sensible heat load is effected in the indoor heat exchanger of each of the personal air-conditioning units.

14 Claims, 13 Drawing Sheets

AIR CONDITIONING APPARATUS HAVING AMBIENT AIR-CONDITIONING UNIT AND A PLURALITY OF PERSONAL AIR-CONDITIONING UNITS CONNECTED TO OUTDOOR UNIT

BACKGROUND OF THE INVENTION

1. Field of the Invention

This invention relates to a multi-type air-conditioning apparatus having a plurality of air-conditioning units connected to an outdoor unit. 2. Description of the Related Art A multi-type air conditioning apparatus having a plurality of indoor units connected to an outdoor unit is known. For example, such a multi-type air-conditioning apparatus is disclosed in Japanese Patent Disclosure No. 1-203856 and U.S. Pat. No. 4,926,652.

Further, an air conditioning apparatus having a plurality of personal air-conditioning units instead of a plurality of indoor units is provided. The personal air-conditioning units are disposed on a large number of desks are installed in a room, for example, to separately air-condition various spaces in the room.

When the air conditioning apparatus having a plurality of personal air-conditioning units is installed in an office of a building, the refrigerant pipe and drain pipe are generally disposed in the space under the floor. Such a space is called a free access floor.

However, a free access floor is originally provided for accommodating electrical, wirings for a computer and business machines. The depth of the floor thereof is set to at most approx. 10 cm. The depth imitation is imposed on the free access floor because if the difference between the room floor and the corridor floor becomes too large, it creates an inconvenience when going into or out of the room. Also, ceiling of the room becomes relatively low creating a sense of oppression when the depth of the free access floor is set excessively large.

When the drain pipe is disposed in such a free access floor, the inclination of the drain pipe cannot be made large. Therefore, dust will tend to be deposited in the drain pipe and the pipe will be clogged with the dust.

In order to solve the above problem, a method of forming an opening in the concrete slab lying below the free access floor and extending the drain pipe to the lower floor via the opening is considered.

However, with the above method, it is necessary to form a new opening in the concrete slab each time the arrangement of the desks disposed on the floor is changed and to fill up the old opening. This construction work is extremely troublesome.

As is disclosed in Japanese Patent Disclosure No. 2-302532, a cooling system having cooling units provided for a plurality of heat-generating units installed on the same floor is proposed. In this case, it is also difficult to provide adequate drainage in the limited space.

The capacity of the personal air-conditioning unit is approx. 0.1 to 0.5 horse power. In contrast, the capacity of a compressor in an outdoor unit is 5 to 10 horse power. The capability controlling range of the compressor of this class is approximately one horse power at minimum, even in an inverter-driven type compressor.

Therefore, when only one personal air-conditioning unit is used, it is necessary to save the capability thereof to approximately 0.1 horse power in order to set up a comfortable air-conditioned environment with less temperature variation. This is impossible to do.

SUMMARY OF THE INVENTION

An object of this invention is to provide an air conditioning apparatus in which a drain pipe of a personal air-conditioning unit can be omitted, thereby making the construction thereof simple and the construction therefor simple. The optimum capability corresponding to the number of personal air-conditioning units to be driven can be attained even when the total number of the personal air-conditioning units to be driven is small making it possible to always set up the comfortable air-conditioned environment.

The above object can be attained by an air conditioning apparatus having an ambient air-conditioning unit and a plurality of personal air-conditioning units connected to an outdoor unit comprising a compressor provided in the outdoor unit for drawing in, compressing and discharging refrigerant; an outdoor heat exchanger provided in the outdoor unit for exchanging the heat of received refrigerant with the heat of external air; an indoor heat exchanger provided in the ambient air-conditioning unit for exchanging the heat of received refrigerant with the heat of internal air; a plurality of indoor heat exchangers provided in the respective personal air-conditioning units for exchanging the heat of received refrigerant with the heat of internal air; means for transferring the refrigerant discharged from the compressor into the outdoor heat exchanger, transferring the refrigerant from the outdoor heat exchanger into the indoor heat exchanger of the ambient air-conditioning unit and then returning the refrigerant from the indoor heat exchanger into the compressor, thus cooling the whole space in the room; means for transferring the refrigerant discharged from the compressor into the outdoor heat exchanger, transferring the refrigerant from the outdoor heat exchanger into the indoor heat exchangers of the personal air-conditioning units and then returning the refrigerant from the indoor heat exchangers into the compressor, thus separately cooling the discrete spaces in the room; and means for causing the indoor heat exchanger of the ambient air-conditioning unit to effect the process for the sensible heat load and the latent heat load and causing the indoor heat exchangers of the personal air-conditioning units to effect only the process for the sensible heat load.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description give above and the detailed description of the preferred embodiments given below, serve to explain the principles of the invention.

DETAILED DESCRIPTION OF THE PREFERRED EMBODIMENTS

There will now be described an embodiment of this invention with reference to the accompanying drawings.

Figure 1:
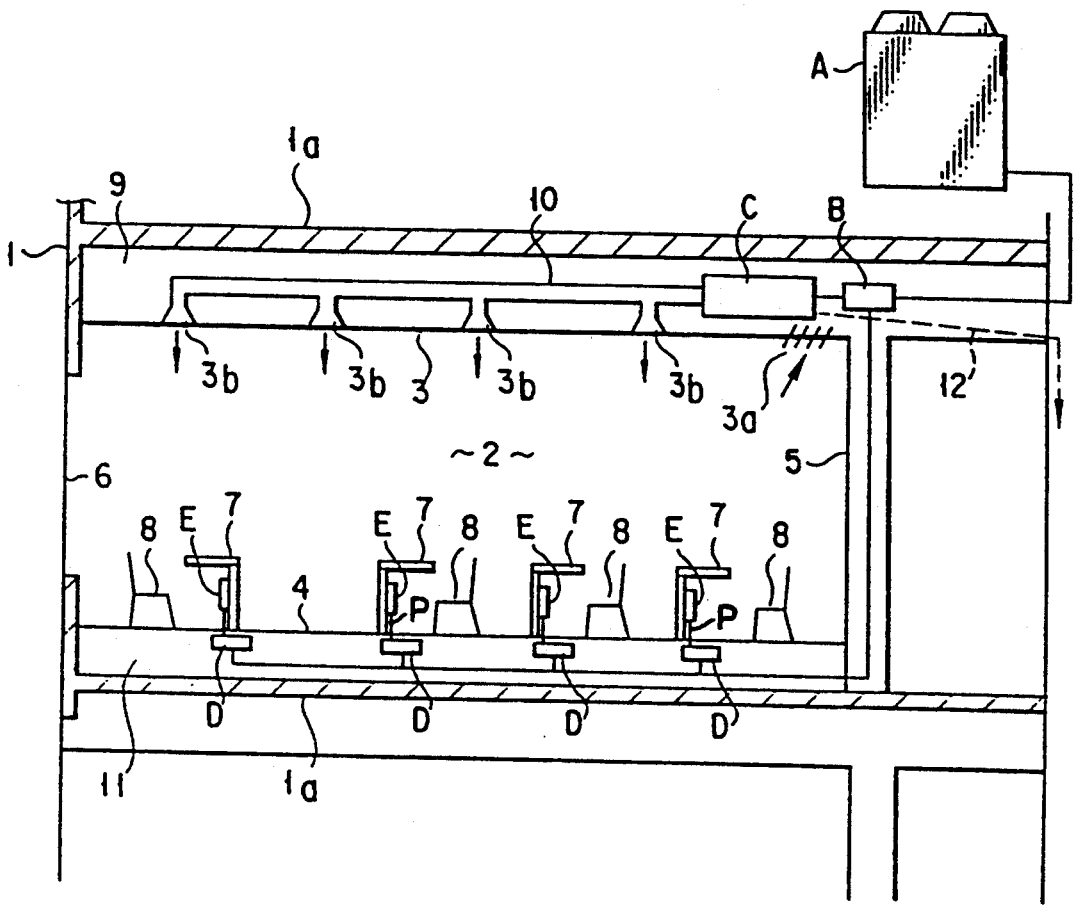
FIG. 1 is a construction view showing the whole construction of first and second embodiments of this invention.

As shown in FIG. 1, a room 2 is provided on each floor of a building 1. The internal space of the room 2 is surrounded by a ceiling plate 3, floor 4, wall 5 and window 6.

An air inlet port 3*a* and a plurality of air outlet ports 3*b* for air-conditioning are formed in the ceiling plate 3. A large number of desks 7 and chairs 8 are placed on the floor 4.

A concrete slab 1*a* isolating the room from an upstairs room is provided over the ceiling plate 3 and a space 9 is defined between the concrete slab 1*a* and the ceiling plate 3. In the space 9, an ambient air-conditioning unit C is disposed near the air inlet port 3*a*.

The ambient air-conditioning unit C is used for air-conditioning the whole space of the room. The outlet port of the ambient air-conditioning unit C is connected to the air outlet ports 3*b* by means of a duct 10.

Personal air-conditioning units E are respectively attached to the desks 7 which are placed on the floor 4. The personal air-conditioning units E are used for separately air-conditioning spaces around the desks 7.

A concrete slab 1*a* for isolating the room from a downstair room is provided below the floor 4 and a space 11 is defined between the concrete slab 1*a* and the floor 4. The space 11, called a free access floor, is originally provided for accommodating the electrical wirings of computer and business machines.

A plurality of flow dividing units D and a refrigerant pipe for connecting an outdoor unit A to the personal air-conditioning units E are disposed in the free access floor 11. Cooling medium pipes P of the personal air-conditioning units E are connected to the respective flow dividing units D. The refrigerant pipes P can be detachably connected to the flow dividing units D.

A distribution unit B is arranged in the space 9 on the upper side of the ceiling plate 3. The distribution unit B is connected to the ambient air-conditioning unit C and the flow dividing units D by means of refrigerant pipes.

The outdoor unit A is disposed on the rooftop of the building 1, for example, and is connected to the distribution unit B via a refrigerant pipe.

The ambient air-conditioning unit C is connected to a drain pipe 12 which is derived discharged out to the exterior of the building 1.

Figure 2:
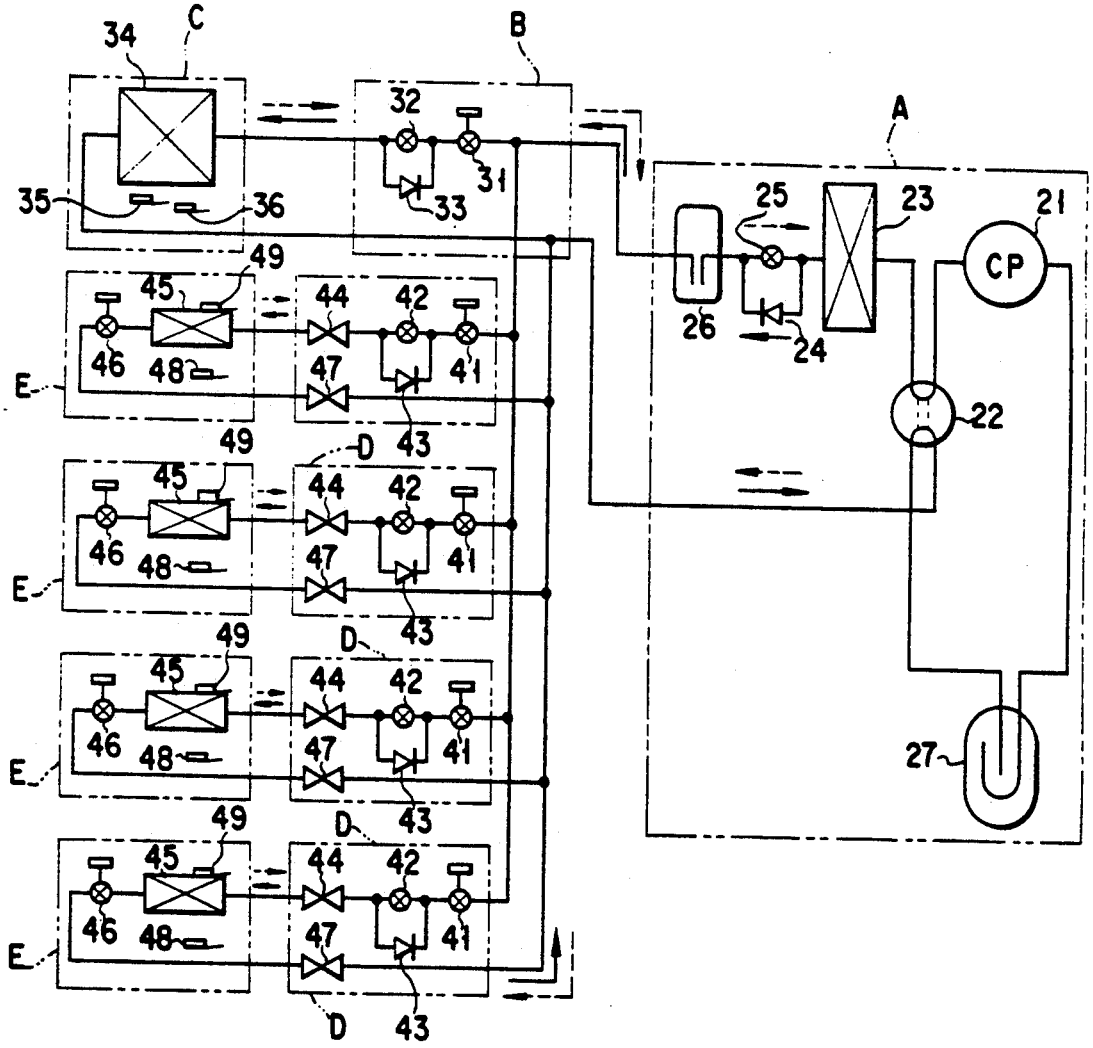
FIG. 2 is a construction diagram showing a refrigerating cycle in the first embodiment.

The outdoor unit A, distribution unit B, ambient air-conditioning unit C, flow dividing units D and personal air-conditioning units E are connected to one another via the refrigerant pipes to constitute a refrigerant cycle shown in FIG. 2.

The outdoor unit A includes a variable-capability compressor 21, four-way valve 22, outdoor heat exchanger 23, check valve 24, expansion valve 25 for heating, liquid receiver 26 and accumulator 27. The compressor 21 draws in, compresses and discharges the refrigerant.

The distribution unit B includes a flow control valve 31 using a pulse motor valve (PMV), expansion valve 32 for cooling and check valve 33.

The ambient air-conditioning unit C includes an indoor heat exchanger 34, air temperature sensor 35 and air humidity sensor 36. The air temperature sensor 35 serves to sense the temperature of air in the room. The air humidity sensor 36 serves to sense the humidity of air in the room.

Each of the flow dividing units D includes a flow control valve 41 using a pulse motor valve, expansion valve 42 for cooling, check valve 43 and two-way valves 44 and 47.

Each of the personal air-conditioning units E includes an evaporative pressure regulator 46 using a pulse motor valve, air temperature sensor 48 and heat exchanger temperature sensor 49. The air temperature sensor 48 serves to sense the temperature of air around the desk 7. The heat exchanger temperature sensor 49 is disposed on an indoor heat exchanger 45 to detect the temperature of the indoor heat exchanger 45.

The outlet port of the compressor 21 is connected to the outdoor heat exchanger 23 via the four-way valve 24. The outdoor heat exchanger 23 is connected to the liquid receiver 26 via a parallel circuit of the check valve 24 and expansion valve 25.

The indoor heat exchanger 34 is connected to the liquid receiver 26 via a parallel circuit of the expansion valve 32 and check valve 33 and the flow control valve 31. The indoor heat exchanger 34 is connected to the inlet port of the compressor 21 via the four-way valve 22 and accumulator 27.

The indoor heat exchanger 45 is connected to the liquid receiver 26 via the two-way valve 44, a parallel circuit of the expansion valve 42 and check valve 43 and the flow control valve 41. The indoor heat exchanger 45 is connected to the inlet port of the compressor 21 via the evaporative pressure regulator 46, two-way valve 47, four-way valve 22 and accumulator 27.

Each of the personal air-conditioning units E has the same construction and is connected in the same manner.

Figure 3:
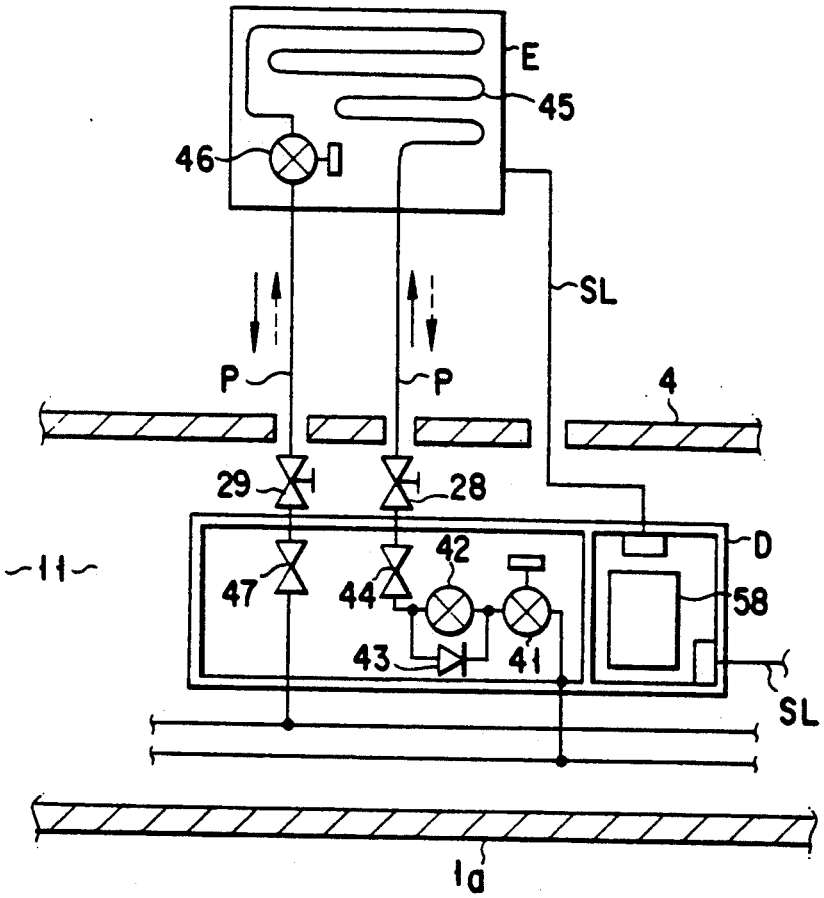
FIG. 3 is a diagram showing the connection of a refrigerant pipe between a personal air-conditioning unit E and a flow dividing unit D in the first embodiment.

The refrigerant pipes P of the personal air-conditioning unit E can be freely connected to or disconnected from the flow dividing unit D by use of two-way valves 28 and 29 provided in the free access floor 11 as shown in FIG. 3. Further, the personal air-conditioning unit E and the flow dividing unit D are connected to each other via a signal line SL.

Figure 4:
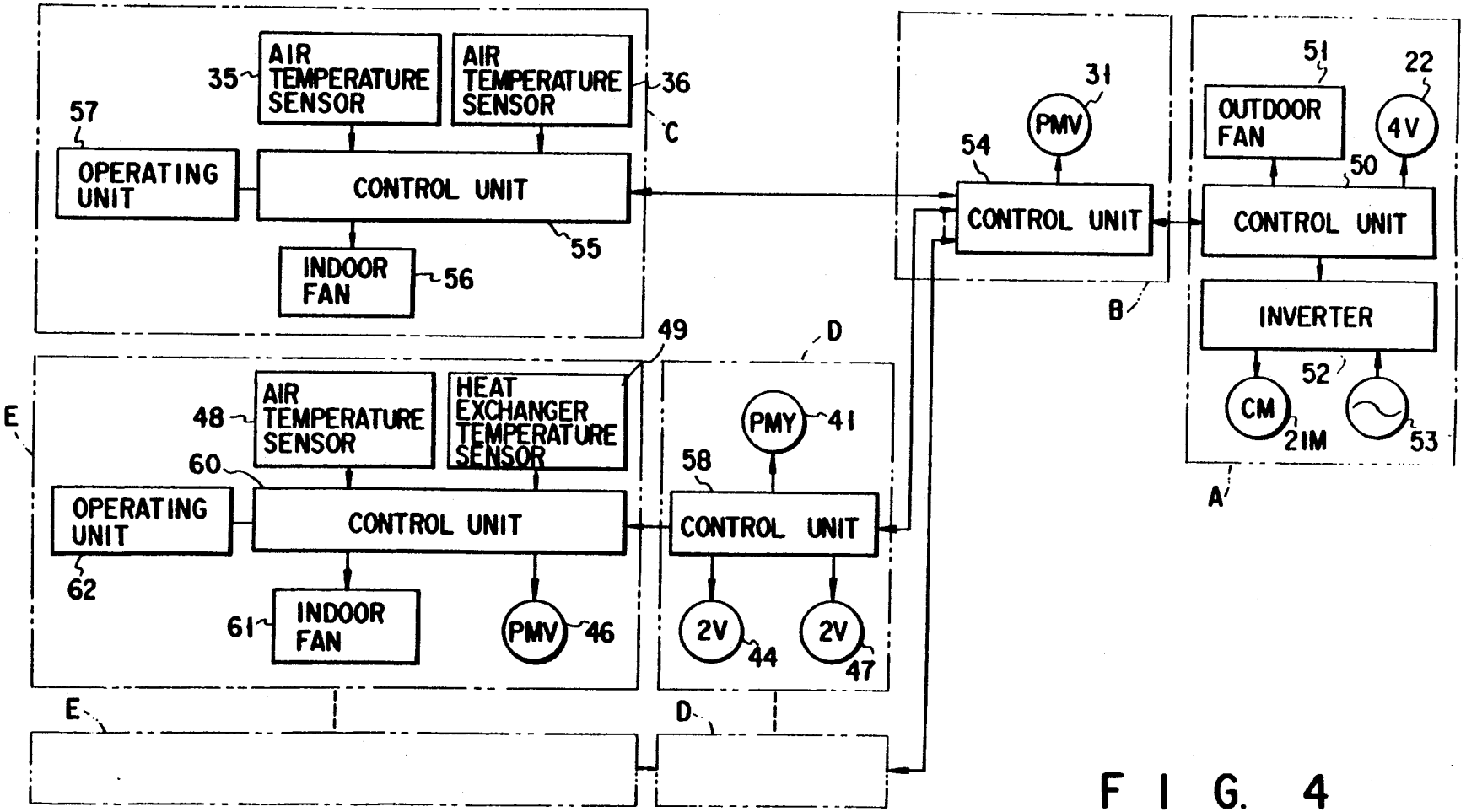
FIG. 4 is a block diagram showing the construction of a control circuit in the first embodiment.

FIG. 4 shows a control circuit.

The outdoor unit A includes a control unit 50 having a microcomputer and a peripheral circuit thereof. The control unit 50 is connected to the four-way valve 22, outdoor fan 51 and inverter 52.

The outdoor fan 51 feeds external air into the outdoor heat exchanger 23.

The inverter 52 rectifies a voltage of a commercial A.C. power source 53, converts the voltage into a voltage of frequency corresponding to the instruction from the control unit 50 and outputs the same. The output voltage is used as the driving power for a motor 21M of the compressor 21.

The distribution unit B includes a control unit 54 having a microcomputer and a peripheral circuit thereof. The control unit 54 is connected to the flow control valve 31.

The ambient air-conditioning unit C includes a control unit 55 having a microcomputer and a peripheral circuit thereof. The control unit 55 is connected to the air temperature sensor 35, air humidity sensor 36, indoor fan 56, and remote control type operating unit 57. The indoor fan 56 feeds internal air into the indoor heat exchanger 34.

Each of the flow dividing units D includes a control unit 58 having a microcomputer and a peripheral circuit thereof. The control unit 58 is connected to the flow control valve 41 and two-way valves 44 and 47.

Each of the personal air-conditioning units E includes a control unit 60 having a microcomputer and a peripheral circuit thereof. The control unit 60 is connected to the evaporative pressure regulator 46, air temperature sensor 48, heat exchanger temperature sensor 49, indoor fan 61 and remote control type operating unit 62. The indoor fan 61 feeds internal air into the indoor heat exchanger 45.

The control units are connected to one another via signal lines, making it possible to transfer data between them.

The control unit 60 for the personal air-conditioning conditioning unit E has the following functional abilities [1] to [5].

[1] The ability to control the operation according to the instruction of operation mode, operation-ON instruction and operation-OFF instruction generated by the operation of the operating unit 62 and transferring the instructions to the flow dividing unit D.

[2] The ability to derive a difference $\Delta T$ between the detected temperature $T_a$ of the air temperature sensor 48 and the preset temperature $T_s$ set by use of the operating unit 62 as an air-conditioning load and informing the flow dividing unit D of the air-conditioning load.

[3] The ability to derive a dew point temperature $T_{ed}$ of the internal air from humidity data (detected humidity $H_{ao}$ to be described later) and temperature data (detected temperature $T_{ao}$ to be described later) obtained in the ambient air-conditioning unit C and supplied via the distribution unit B and flow dividing unit D at the time of cooling operation.

[4] The ability to compare the detected dew point temperature $T_{ed}$ with the detected temperature $T_e$ of the heat exchanger temperature sensor 49 and adjusting the opening of the evaporative pressure regulator 46 so as to set the detected temperature $T_e$ equal to or higher than the dew point temperature $T_{ed}$. The comparison ability causes the indoor heat exchanger 45 to effect only the process for a sensible heat load and inhibits the indoor heat exchanger 45 from effecting the process for a latent heat load. That is, only the cooling operation is effected and the dehumidification operation is not effected.

[5] The ability to fully open the evaporative pressure regulator 46 at the heating time.

The control unit 58 of the flow dividing unit D has the following functional abilities [1] to [5].

[1] The ability to open the two-way valves 44 and 47 when receiving the operation-ON instruction from the personal air-conditioning unit E and closing the two-way valves 44 and 47 when receiving the operation-OFF instruction.

[2] The ability to transfer an instruction from the personal air-conditioning unit E to the distribution unit B.

[3] The ability to control the opening of the flow control valve 41 according to the air-conditioning load of the personal air-conditioning unit E.

[4] The ability to inform the distribution unit B of the air-conditioning load of the personal air-conditioning unit E.

[5] The ability to collect the refrigerant in the personal air-conditioning unit E while sequentially closing the two-way valves 44 and 47 in the operation of separating the personal air-conditioning unit E.

The control unit 55 of the ambient air-conditioning unit C has the following functional [1] to [5].

[1] The ability to control the operation according to the instruction of operation mode, operation-ON instruction and operation-OFF instruction generated by the operation of the operating unit 57 and transferring the instructions to the distribution unit B.

[2] The ability to derive a difference $\Delta T$ between the detected temperature $T_{ao}$ of the air temperature sensor 35 and the preset temperature $T_{so}$ set by use of the operating unit 57 as an air-conditioning load and informing the distribution unit B of the air-conditioning load.

[3] The ability to derive a difference $\Delta H$ between the detected humidity (relative humidity) $H_{ao}$ of the air humidity sensor 36 and a preset relative humidity $H_{so}$ previously stored in an internal memory in the cooling operation; and the ability to control the amount of air fed by the indoor fan 56 so as to control the difference $\Delta H$ within a preset range.

[4] The ability to inform the distribution unit B of the detected temperature $T_{ao}$ of the air temperature sensor 35 and the detected humidity (relative humidity) $H_{ao}$ of the air humidity sensor 36.

[5] The ability to start the operation when receiving even a single operation-ON instruction of the personal air-conditioning unit E from the distribution unit B.

The control unit 54 of the distribution unit B has the following functional abilities [1] and [2].

[1] The ability to control the opening of the flow control valve 31 according to the air-conditioning load of the ambient air-conditioning unit C.

[2] The ability to effect the transfer of instructions and data between the respective flow dividing units D and the ambient air-conditioning unit C.

The control unit 50 of the outdoor unit A has the following functional abilities [1] to [3].

[1] The ability to derive the total sum of the air-conditioning loads of the ambient air-conditioning unit C and the respective personal air-conditioning units E.

[2] The ability to control the output frequency of the inverter 52 according to the detected total sum of the air-conditioning loads.

[3] The ability to control the valve position of the four-way valve 22 according to the instruction of operation mode.

Next, the operation is explained.

Assume that the cooling operation mode and a desired room temperature $T_s$ are set in at least one of the personal air-conditioning units E and the operation thereof is started.

Then, the operation of the compressor 21 is started to permit the refrigerant to flow from the outdoor unit A into the personal air-conditioning unit E via the distribution unit B and flow dividing unit D as shown by arrows indicated by solid lines in FIG. 2.

That is, the refrigerant discharged from the compressor 21 flows into the outdoor heat exchanger 23 via the four-way valve 22. The refrigerant is condensed in the outdoor heat exchanger 23.

The refrigerant passing through the outdoor heat exchanger 23 flows into the indoor heat exchanger 45 via the check valve 24, liquid receiver 26, flow control valve 41 corresponding to the personal air-conditioning unit E which generates the operation request, expansion valve 42 and two-way valve 44. The refrigerant evaporates in the indoor heat exchanger 45.

The refrigerant passing through the indoor heat exchanger 45 flows into the compressor unit 21 via the evaporative pressure valve 46, two-way valve 47, four-way valve 22 and accumulator 27.

Thus, the outdoor heat exchanger 23 acts as a condenser, the indoor heat exchanger 45 acts as an evaporator, and the space around the desk 7 is separately cooled by the personal air-conditioning unit E.

At this time, the operation of the ambient air-conditioning unit C is automatically started in connection with the operation of the personal air-conditioning unit E and the refrigerant flows from the distribution unit B into the ambient air-conditioning unit C.

That is, part of the refrigerant passing through the liquid receiver 26 flows into the indoor heat exchanger 34 via the flow control valve 31 and expansion valve 32. The refrigerant evaporates in the indoor heat exchanger 34.

The refrigerant passing through the indoor heat exchanger 34 meets and flows together with the refrigerant to the four-way valve 22 and fed into the compressor 21 via the accumulator 27.

Thus, the indoor heat exchanger 34 acts as an evaporator to cool the whole space in the room 2.

Figure 5:
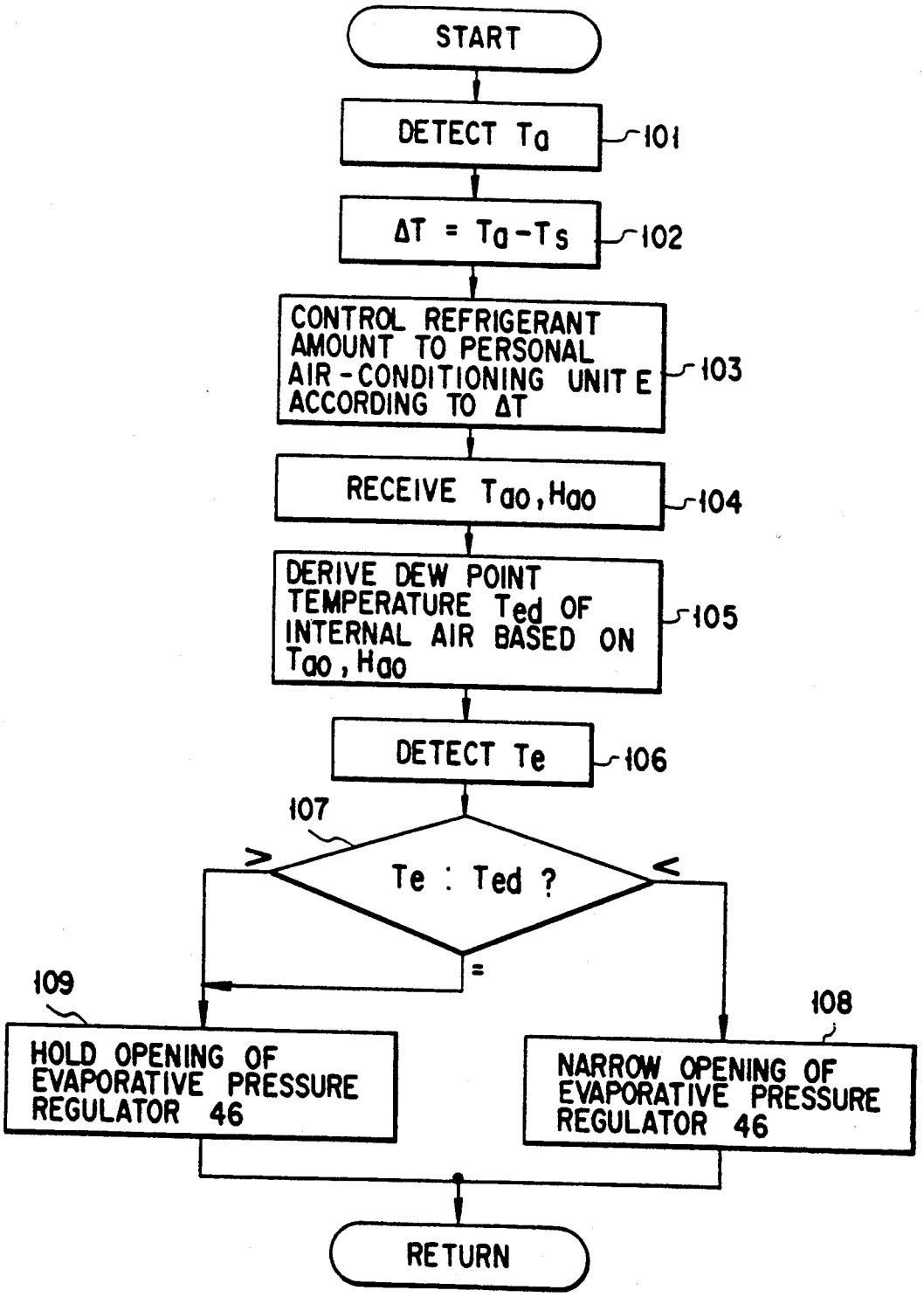
FIG. 5 is a flowchart showing the operation of controlling the personal air-conditioning unit and the flow dividing unit in each of the first and second embodiments.

At the time of cooling operation, the operation of controlling the personal air-conditioning units E and flow dividing units D as shown in FIG. 5 is effected.

First, the temperature $T_a$ of the air around the desk 7 is detected by use of the air temperature sensor 48 (step 101). A difference $\Delta T$ ($=T_a-T_s$) between the detected temperature $T_a$ and the preset temperature $T_s$ set by use of the operating unit 62 is detected as an air-conditioning load (step 102). Then, the opening of the flow control valve 41 is controlled so that the refrigerant of an amount corresponding to the air-conditioning load may be fed into the personal air-conditioning unit E (step 103).

The detected temperature (internal air temperature) $T_{ao}$ derived from the ambient air-conditioning unit C and the detected humidity (relative humidity) $H_{ao}$ are received (step 104). The dew point temperature $T_{ed}$ of the internal air is derived from the detected temperature $T_{ao}$ and detected humidity $H_{ao}$ (step 105).

The temperature $T_e$ of the indoor heat exchanger 45 is detected by the heat exchanger temperature sensor 49 (step 106). The detected temperature $T_e$ and the derived dew point temperature $T_{ed}$ are compared with each other (step 107).

If it is detected as the result of comparison that the detected temperature $T_e$ is lower than the derived dew point temperature $T_{ed}$, the opening of the evaporative pressure regulator 46 is gradually narrowed by a preset amount at one time until the detected temperature $T_e$ becomes equal to or higher than the derived dew point temperature $T_{ed}$ (step 108).

When the detected temperature $T_e$ becomes equal to or higher than the derived dew point temperature $T_{ed}$, the opening of the evaporative pressure regulator 46 set at this time is held (step 109).

For example, when the detected temperature $T_{ao}$ derived from the ambient air-conditioning unit C is 27° C. and the detected humidity $H_{ao}$ is 50%, the dew point temperature of the internal air becomes 15.5° C. Therefore the opening of the evaporative pressure regulator 46 is so adjusted that the detected temperature $T_e$ will not become lower than 15.5° C.

Only the process for the sensible heat load is effected by the adjustment of the opening of the evaporative pressure valve 46 by use of the indoor heat exchanger 45 and the process for the latent heat load is not effected. That is, each of the personal air-conditioning units E effects the cooling operation and does not effect the dehumidification operation.

Figure 6:
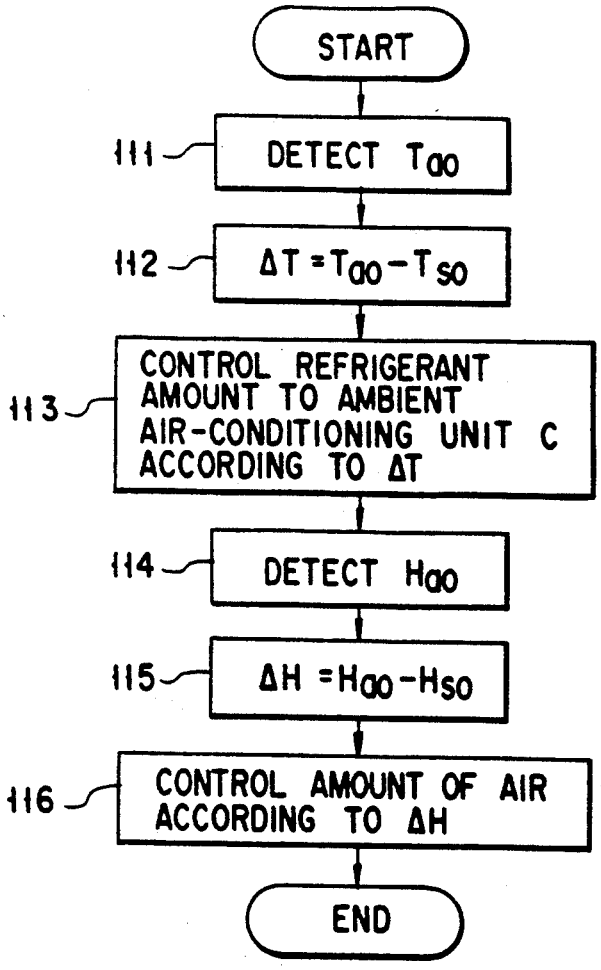
FIG. 6 is a flowchart showing the operation of controlling a distribution unit B and an ambient air-conditioning unit C in each of the first and second embodiments.

The control operation shown in FIG. 6 is effected in the ambient air-conditioning unit C and the distribution unit B.

First, the temperature $T_{ao}$ of the internal air in the room 2 is detected by the air temperature sensor 35 (step 111). A difference $\Delta T$ ($=T_{ao}-T_{so}$) between the detected temperature $T_{ao}$ and the preset temperature $T_{so}$ set by use of the operating unit 57 is detected as an air-conditioning load (step 112). Then, the opening of the flow control valve 31 is controlled so that the refrigerant of an amount corresponding to the air-conditioning load may be fed into the ambient air-conditioning unit C (step 113)

The relative humidity $H_{ao}$ of the internal air in the room 2 is detected by use of the air humidity sensor 36 (step 114). A difference $\Delta H$ ($=H_{ao}-H_{so}$) between the detected humidity $H_{ao}$ and the preset relative humidity $H_{so}$ previously stored in the internal memory is derived (step 115). The amount of air fed from the indoor fan 56 is so controlled that the difference $\Delta H$ may be set within a preset range (step 116).

Therefore, the indoor heat exchanger 34 effects both of the process for the latent heat load and the process for the sensible heat load. That is, both of the cooling process and dehumidification process are effected in the ambient air-conditioning unit C. The drain caused by the dehumidification is discharged t the exterior of the building 1 by means of the drain pipe 12.

Figure 7:
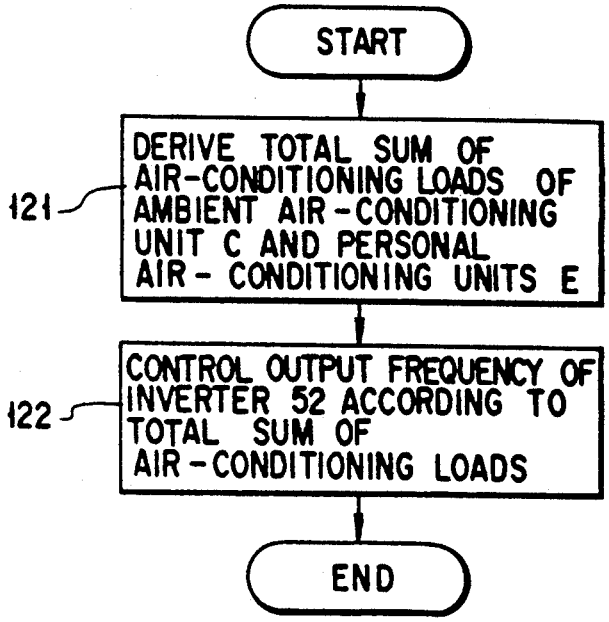
FIG. 7 is a flowchart showing the operation of controlling an outdoor unit in the first embodiment.

The control operation shown in FIG. 7 is effected in the outdoor unit A.

The total sum of the air-conditioning load of the ambient air-conditioning unit C and the air-conditioning loads of the personal air-conditioning units E is derived (step 121). The output frequency of the inverter 52 is controlled according to the derived total sum. As a result, the compressor 21 displays the optimum capability for the total sum of the air-conditioning loads.

Thus, by effecting both of the cooling operation and dehumidification operation in the ambient air-conditioning unit C and effecting only the cooling operation in the personal air-conditioning units E, a comfortable environment can be set up in the room 2 without causing any dew in the indoor heat exchangers 45 of the personal air-conditioning units E. That is, no drain is caused from the personal air-conditioning units E.

That is, since it is not necessary at all to dispose a drain pipe in the free access floor 11 of limited space, the construction becomes simple and the cost is lowered. Further, since it is not necessary at all to form an opening for pipe laying in the concrete slab 1*a* under the floor 1*a*, the installation work becomes simple. Further, the maintenance service becomes easy.

In addition, since the operation of the ambient air-conditioning unit C is automatically started in connection with the operation of at least one of the personal air-conditioning units E, a relatively good balance can be attained between the load and the capability of the compressor 21 and the comfortable air-conditioning can be always attained even when only one of the personal air-conditioning units E is operated.

Further, since the personal air-conditioning units E can be freely connected to or disconnected from the respective flow dividing units D, a proper measure can be immediately taken even when the number of desks 7 or the arrangement thereof is changed.

Assume that the heating operation mode is set in at least one of the personal air-conditioning units E and the operation thereof is started.

Then, the operation of the compressor 21 is started to permit the refrigerant to flow from the outdoor unit A into the personal air-conditioning unit E via the distribution unit B and flow dividing unit D as shown by arrows indicated by broken lines in FIG. 2.

That is, the valve position of the four-way valve 22 is changed, and the refrigerant discharged from the compressor 21 passes through the four-way valve 22, two-way valve 47 corresponding to the personal air-conditioning unit E which is generating the request of operation and evaporative pressure regulator 46 and then flows into the indoor heat exchanger 45. In the indoor heat exchanger 45, the refrigerant is condensed. At this time, the evaporative pressure regulator 46 is set in the fully open state.

The refrigerant passing through the indoor heat exchanger 45 is passed through the two-way valve 44, check valve 43, flow control valve 41, liquid receiver 26 and expansion valve 25 and then flows into the outdoor heat exchanger 23. The refrigerant evaporates in the outdoor heat exchanger 23.

The refrigerant passing through the outdoor heat exchanger 23 is passed through the four-way valve 22 and accumulator 27 and drawn into the compressor 21.

Thus, the indoor heat exchanger 45 acts as a condenser and the outdoor heat exchanger 23 acts as an evaporator, and the space around the desk 7 can be separately heated by use of the personal air-conditioning unit E.

At this time, the operation of the ambient air-conditioning unit C is automatically started in connection with the operation of the personal air-conditioning unit E and the refrigerant flows from the distribution unit B into the ambient air-conditioning unit C.

That is, part of the refrigerant passing through the four-way valve 22 passes through the check valve 34 and flow control valve 31 and then meets and flows together with the refrigerant flowing into the liquid receiver 26.

Thus, the indoor heat exchanger 34 acts as a condenser to heat the whole space in the room 2.

In the above embodiment, the evaporative pressure regulator 46 is disposed in the personal air-conditioning unit E, but it can be disposed in the flow dividing unit D.

Figure 8:
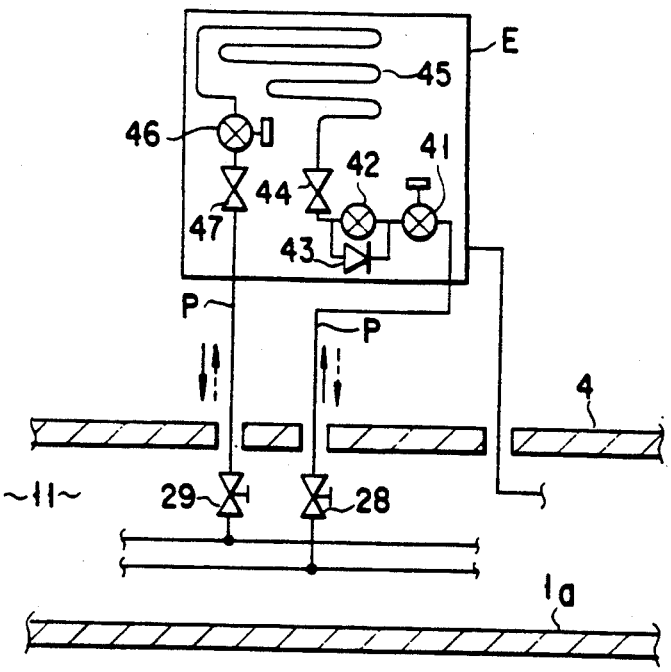
FIG. 8 is a diagram showing the connection of a refrigerant pipe between a personal air-conditioning unit E and a flow dividing unit D in the modification of the first embodiment.

All of the parts of the flow dividing unit D may be incorporated into the personal air-conditioning unit E as shown in FIG. 8. In this case, even if the free access floor 11 is extremely small, it becomes possible to use the flow dividing unit.

Figure 9:
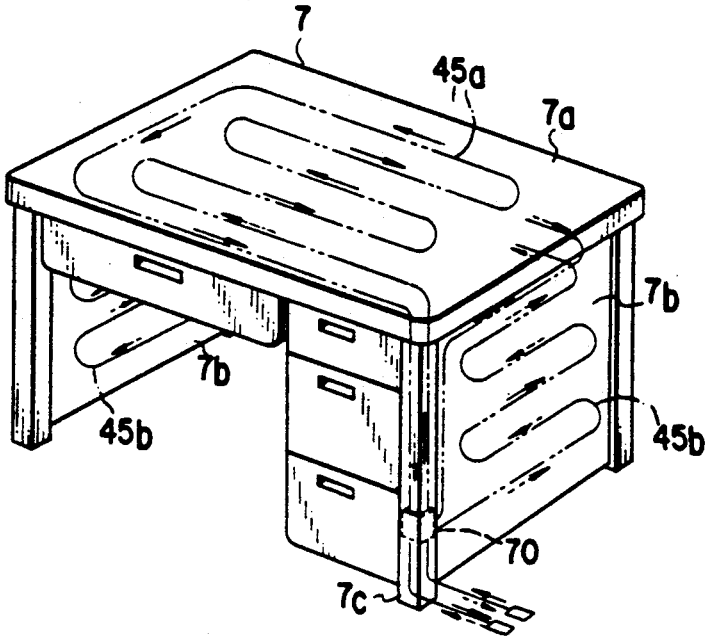
FIG. 9 is a construction diagram showing a desk in the modification of the first embodiment.

FIG. 9 shows the construction of another modification.

The indoor heat exchanger 45 of the personal air-conditioning unit E is divided into one heat exchanger 45*a* exclusively used for cooling and two heat exchangers 45*b*, 45*b* exclusively used for heating.

The heat exchanger 45*a* is mounted on the under surface side of a roof 7*a* of the desk 7. The heat exchangers 45*b*, 45*b* are respectively mounted on the insides of the side plates 7*b*, 7*b* of the desk 7.

A slider 70 which can be slidably moved by the manual operation is mounted on one of legs 7*c* of the desk 7. The slider 70 has a function to selectively permit the communication of the refrigerant to the heat exchanger 45*a* or the communication of the refrigerant to the heat exchangers 45*b*.

Figure 10:
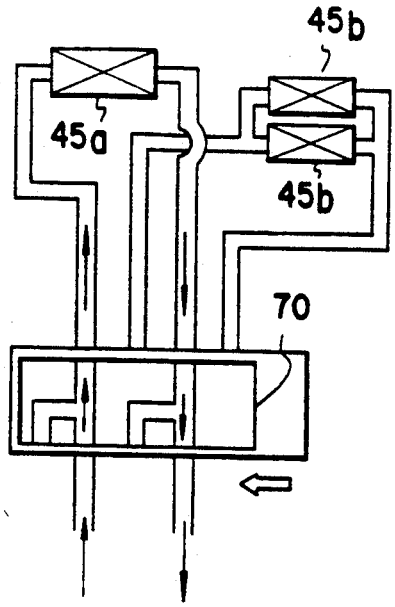
FIG. 10 is a construction diagram showing the main portion in FIG. 9.

That is, in the cooling operation, the slider 70 is set in the left position as shown in FIG. 10 to permit the communication of the refrigerant to the heat exchanger 45*a*.

Figure 11:
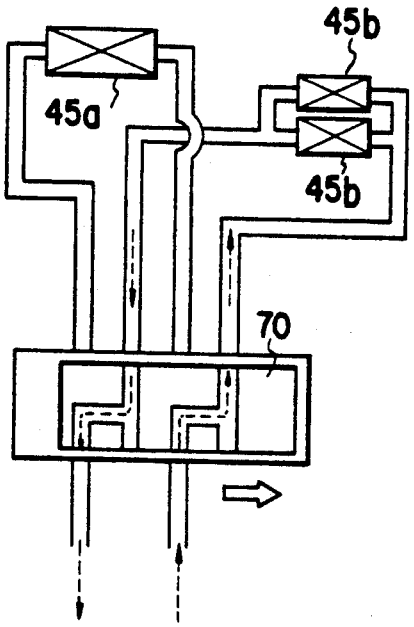
FIG. 11 is a construction diagram showing the main portion in FIG. 9.

In the heating operation, the slider 70 is set in the right position as shown in FIG. 11 to permit the communication of the refrigerant to the heat exchangers 45*b*.

Further, in the above embodiment, the dew point temperature of the internal air is detected by use of the temperature and humidity detected by means of the ambient air-conditioning u it C, but it is also possible to detect the temperature and humidity by use of the personal air-conditioning units E and detect the dew point temperatures for the respective personal air-conditioning units E.

Next, a second embodiment of this invention is explained with reference to the accompanying drawings.

In this embodiment, the whole construction is similar to that of the first embodiment except the construction of the refrigerating cycle. In the drawings, portions which are the same as those of the first embodiment are denoted by the same reference numerals.

Figure 12:
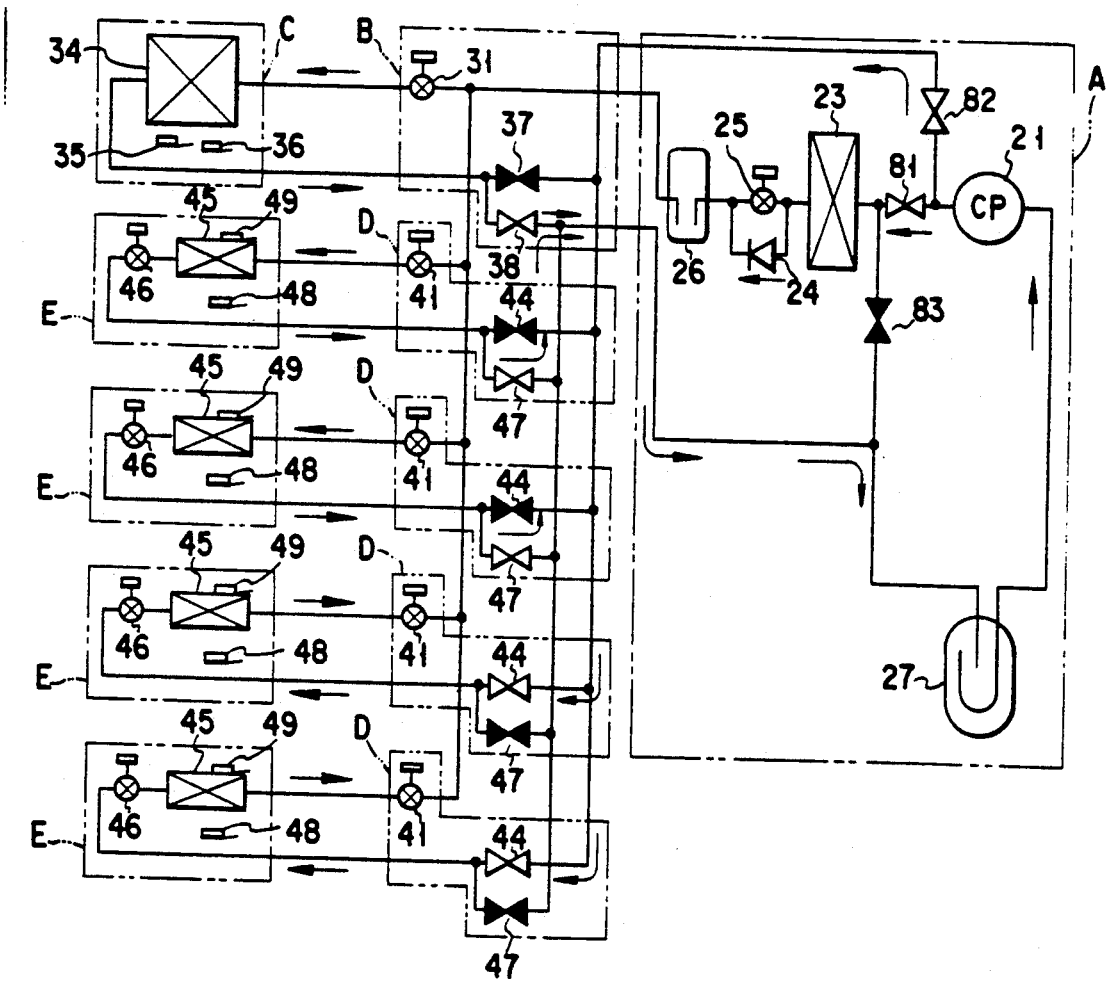
FIG. 12 is a construction diagram showing the refrigerating cycle in the second embodiment.

As shown in FIG. 12, the outdoor unit A includes a variable-capability compressor 21, outdoor heat exchanger 23, check valve 24, expansion valve 25 for heating, liquid receiver 26, accumulator 27 and two-way valves 81, 82, 83. The compressor 21 draws in, compresses and discharges the refrigerant.

The distribution unit B includes a flow control valve 31 using a pulse motor valve and two-way valves 37 and 38.

The ambient air-conditioning unit C includes an indoor heat exchanger 34, air temperature sensor 35 and air humidity sensor 36.

Each of the flow dividing units D includes a flow control valve 41 using a pulse motor valve and two-way valves 44 and 47.

Each of the personal air-conditioning units E includes an indoor heat exchanger 45, evaporative pressure regulator 46 using a pulse motor valve, air temperature sensor 48 and heat exchanger temperature sensor 49.

The outlet port of the compressor 21 is connected to the outdoor heat exchanger 23 via the two-way valve 81. The outdoor heat exchanger 23 is connected to the liquid receiver 26 via a parallel circuit of the check valve 24 and expansion valve 25.

One port of the indoor heat exchanger 34 is connected to the liquid receiver 26 via the flow control valve 31. The other port of the indoor heat exchanger 34 is connected to the inlet port of the compressor 21 via the two-way valve 38 and accumulator 27.

One port of the indoor heat exchanger 45 is connected to the liquid receiver 26 via the flow control valve 41. The other port of the indoor heat exchanger 45 is connected to the inlet port of the compressor 21 via the evaporative pressure regulator 46, two-way valve 47 and accumulator 27.

The other port of the indoor heat exchanger 34 is also connected to the outlet port of the compressor 21 via the two-way valves 82 and 37.

The other port of the indoor heat exchanger 3 is also connected to the outlet port of the compressor 21 via the two-way valves 82 and 44 and evaporative pressure regulator 46.

A connecting portion between the two-way valve 81 and the outdoor heat exchanger 23 is connected to the inlet port of the compressor 21 via the two-way valve 83 and accumulator 27.

Each of the personal air-conditioning units E has the same construction and is connected in the same manner.

Figure 13:
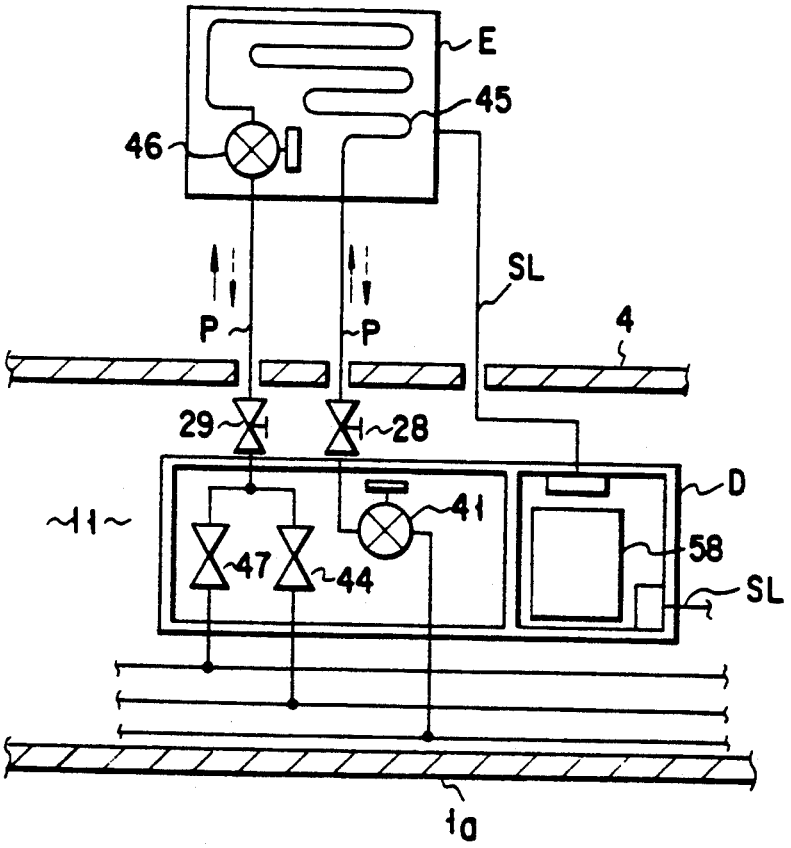
FIG. 13 is a diagram showing the connection of a refrigerant pipe between a personal air-conditioning unit E and a flow dividing unit D in the second embodiment.

The refrigerant pipes P of the personal air-conditioning unit E can be freely connected to or disconnected from the flow dividing unit D by use of manually operated two-way valves 28 and 29 as shown in FIG. 13.

Figure 14:
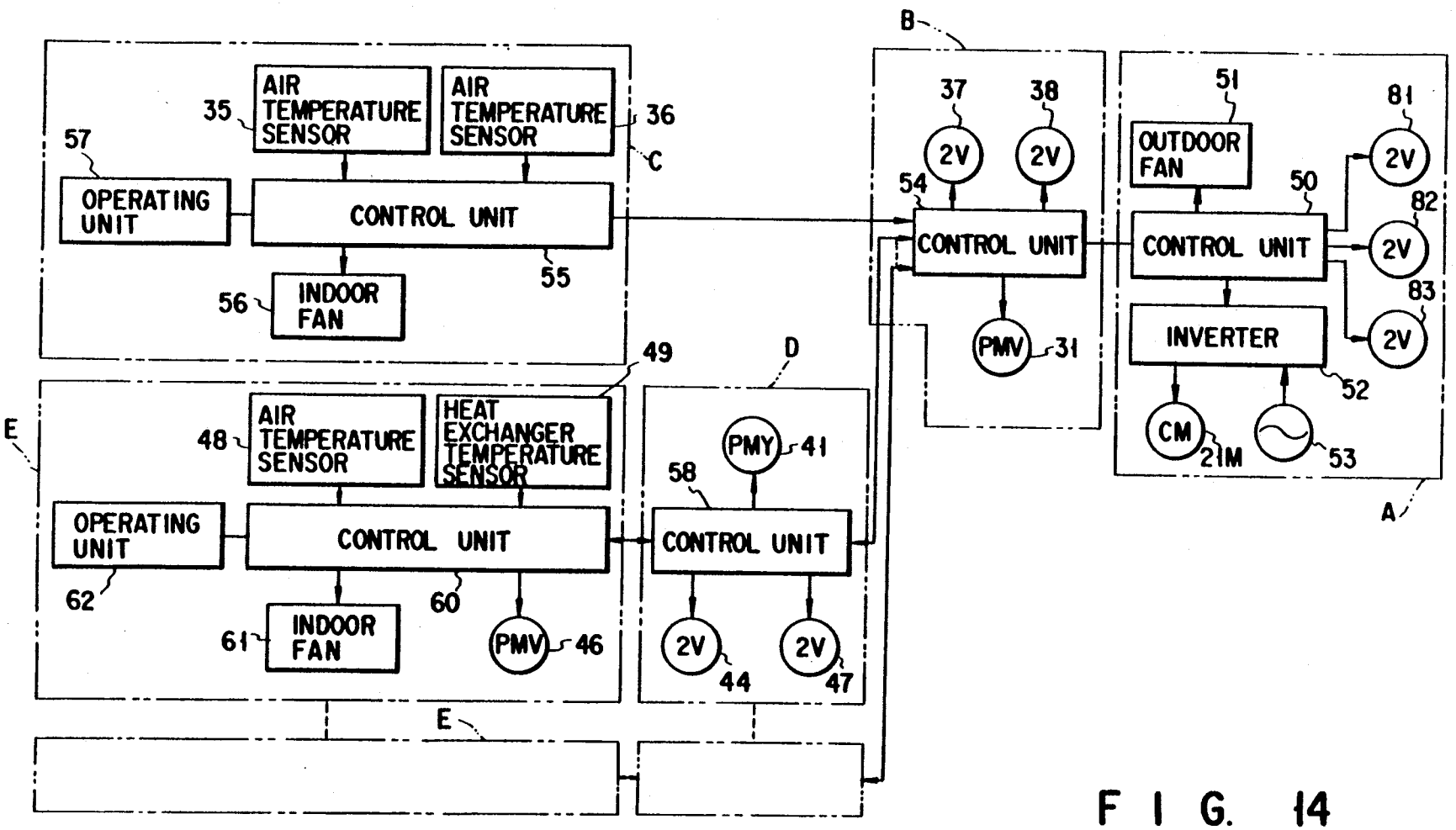
FIG. 14 is a block diagram showing the construction of a control circuit in the second embodiment.

FIG. 14 shows a control circuit.

A control unit 50 of the outdoor unit A is connected to the two-way valves 81, 82, 83, outdoor fan 51 and inverter 52.

A control unit 54 of the distribution unit B is connected to the two-way valves 37, 38 and flow control valve 31.

A control unit 55 of the ambient air-conditioning unit C is connected to the air temperature sensor 35, air humidity sensor 36, indoor fan 56, and remote control type operating unit 57.

A control unit 58 of each of the flow dividing units D is connected to the flow control valve 41 and two-way valves 44 and 47.

A control unit 60 of each of the personal air-conditioning units E is connected to the evaporative pressure regulator 46, air temperature sensor 48, heat exchanger temperature sensor 49, indoor fan 61 and remote control type operating unit 62.

The control units are connected to one another via signal lines, making it possible to transfer data between them.

The control unit 60 of the personal air-conditioning unit E has the same functional means as those described in the first embodiment.

The control unit 58 of the flow dividing units D has the same functional abilities as those described in the first embodiment except the following functional means ability [1] is different.

[1] The ability to open the two-way valve 44 and to close the two-way valve 47 when receiving the instruction of cooling operation mode and the operation-ON instruction from the personal air-conditioning unit E; to close the two-way valve 44 and to open the two-way valve 47 when receiving the instruction of heating operation mode and the operation-ON instruction, and to close both of the two way valves 44 and 47 when receiving the operation-OFF instruction.

The control unit 55 of the ambient air-conditioning unit C has the same functional abilities as those described in the first embodiment.

The control unit 54 of the distribution unit B has the following functional abilities [3] to [6] in addition to the abilities described in the first embodiment.

[3] The ability to determine one of the cooling operation modes and the heating operation modes based on the instruction of the operation mode of each of the personal air-conditioning units E received via the flow dividing unit D and the air-conditioning load of each of the personal air-conditioning units E received via the flow dividing unit D.

[4] The ability to inform the outdoor unit A of the determined operation mode.

[5] The ability to open two-way valve 38 and to close the two-way valve 37 when the cooling operation mode is determined.

[6] The ability to close two-way valve 38 and open the two-way valve 37 when the heating operation mode is determined.

The control unit 50 of the outdoor unit A has the following functional abilities [1] to [3].

[1] The ability to derive the total sum of the air-conditioning load of the ambient air-conditioning unit C and the air-conditioning loads of all of the personal air-conditioning units E that are generating the instruction of cooling operation mode when the cooling operation mode is determined.

[2] The ability to derive the total sum of the air-conditioning load of the ambient air-conditioning unit C and the air-conditioning loads of all of the personal air-conditioning units E that are generating the instruction of heating operation mode when the heating operation mode is determined.

[3 ] The ability to control the output frequency of the inverter 52 according to the derived total sum of the air-conditioning loads.

Next, the operation is described.

Assume that the air-conditioning load (cooling load) of the personal air-conditioning unit or units E which generate the instruction of cooling operation mode is larger than the air-conditioning load (heating load) of the personal air-conditioning unit or units E which generate the instruction of heating operation mode.

In this case, the cooling operation mode is determined, and as shown in FIG. 12, the two-way valves 81 and 82 are opened (indicated by white) and the two-way valve 83 is closed (indicated by black).

The refrigerant discharged from the compressor 21 passes through the two-way valve 81 and flows into the outdoor heat exchanger 23. In the outdoor heat exchanger 23, the refrigerant is condensed.

The refrigerant passing through the outdoor heat exchanger 23 passes through the check valve 24 and liquid receiver 26, the flow control valve 41 corresponding to the personal air-conditioning unit E which generates the request of cooling operation mode and then flows into the indoor heat exchanger 45 of the personal air-conditioning unit E which generates the instruction of cooling operation mode. In the indoor heat exchanger 45, the refrigerant evaporates. Thus, the space around the desk 7 is separately cooled.

The refrigerant passing through the indoor heat exchanger 45 passes through the evaporative pressure regulator 46, two-way valve 47 (indicated by white) and accumulator 27 and is drawn into the compressor 21.

Part of the refrigerant passing through the liquid receiver 26 passes through the flow control valve 31 and flows into the indoor heat exchanger 34. The refrigerant evaporates in the indoor heat exchanger 34. Thus, the whole space in the room 2 is cooled.

The refrigerant passing through the indoor heat exchanger 34 passes through the two-way valve 38 and accumulator 27 and is drawn into the compressor 21.

Part of the refrigerant discharged from the compressor 21 passes through the two-way valve 82, the two-way valve 44 (indicated by white) corresponding to the personal air-conditioning unit E which generates the request of heating operation mode and evaporative pressure regulator 46 and then flows into the indoor heat exchanger 45 of the personal air-conditioning unit E which generates the instruction of heating operation mode. In the indoor heat exchanger 45, the refrigerant is condensed. Thus, the space around the desk 7 is separately heated.

The refrigerant passing through the indoor heat exchanger 45 passes through the flow control valve 41 and meets and flows together with the refrigerant to the personal air-conditioning unit E which generates the instruction of cooling operation mode.

When the cooling operation mode is determined, the control operation shown in FIG. 5 is effected in the flow dividing unit D and personal air-conditioning unit E which generates the instruction of cooling operation mode in the same manner as in the first embodiment. Thus, in the indoor heat exchanger 45, only the process for the sensible heat load is effected and the process for the latent heat load is not effected.

The control operation shown in FIG. 6 is effected in the ambient air-conditioning unit C and distribution unit B in the same manner as in the first embodiment. Thus, both of the processes for the latent heat load and sensible heat load are effected.

Thus, by effecting both of the cooling operation and dehumidification operation in the ambient air-conditioning unit C and effecting only the cooling operation in the personal air-conditioning units E, a comfortable environment can be set up in the room 2 without causing any dew in the indoor heat exchangers 45 of the personal air-conditioning units E. That is, no drain is caused from the personal air-conditioning units E.

Therefore, since it is not necessary at all to dispose a drain pipe in the free access floor 11 of limited space, the construction thereof becomes simple and the cost is lowered. Further, since it is not necessary at all to form an opening for pipe laying in the concrete slab la under the floor 4, the installation work becomes simple. Further, the maintenance service becomes easy.

In addition, since the operation of the ambient air-conditioning unit C is automatically started in connection with the operation of at least one of the personal air-conditioning units E, a relatively good balance can be attained between the load and the capability of the compressor 21 and the comfortable air-conditioning can be always attained even when only one of the personal air-conditioning units E is operated.

Further, since the personal air-conditioning units E can be freely connected to or disconnected from the respective flow dividing units D, a proper measure can be immediately taken even when the number of desks 7 or the arrangement thereof is changed.

Assume that the air-conditioning load (heating load) of the personal air-conditioning unit or units E, which generate the instruction of heating operation mode, is larger than the air-conditioning load (cooling load) of the personal air-conditioning unit or units E, which generate the instruction of cooling operation mode.

Figure 15:
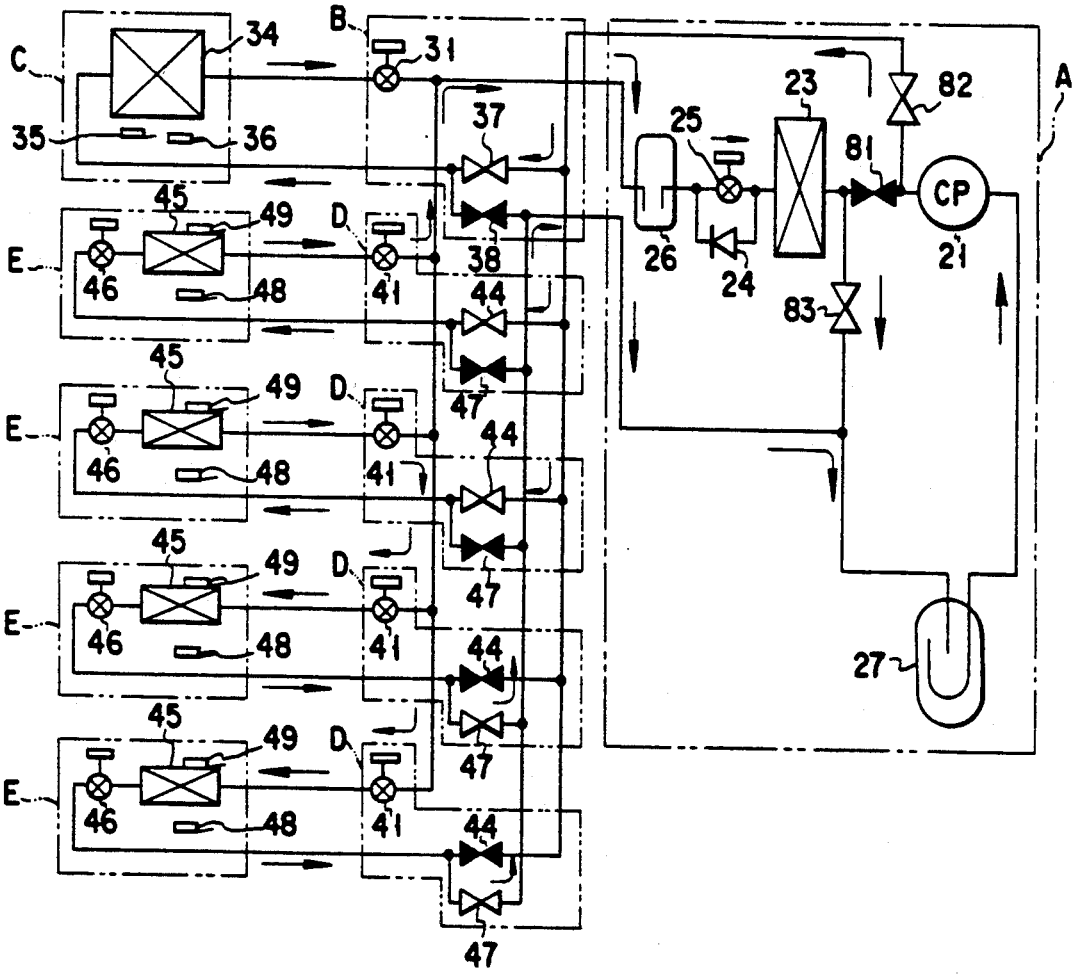
FIG. 15 is a diagram showing the flow of refrigerant at the heating time in the refrigerating cycle in the second embodiment.

In this case, the heating operation mode is determined, and as shown in FIG. 15, the two-way valves 82 and 83 are opened (indicated by white) and the two-way valve 81 is closed (indicated by black).

The refrigerant discharged from the compressor 21 passes through the two-way valve 82, the two-way valve 44 (indicated by white) corresponding to the personal air-conditioning unit E which generates the request of heating operation and the evaporative pressure regulator 46 and then flows into the indoor heat exchanger 45 of the personal air-conditioning unit E which generates the instruction of heating operation mode. In the outdoor heat exchanger 45, the refrigerant is condensed. Thus, the space around the desk 7 is separately heated.

The refrigerant passing through the indoor heat exchanger 45 passes through the flow control valve 41, liquid receiver 26 and expansion valve 25, and then flows into the outdoor heat exchanger 23. In the outdoor heat exchanger 23, the refrigerant evaporates.

The refrigerant passing through the outdoor heat exchanger 23 passes through the two-way valve 83 and accumulator 27 and is drawn into the compressor 21.

The refrigerant discharged from the compressor 21 passes through the two-way valves 82 and 37 and then flows into the indoor heat exchanger 34. The refrigerant is condensed in the indoor heat exchanger 34. Thus, the whole space in the room 2 is heated.

The refrigerant passing through the indoor heat exchanger 34 passes through the flow control valve 31, liquid receiver 26 and expansion valve 25 and then flows into the outdoor heat exchanger 23.

Part of the refrigerant passing through the flow control valve 41 corresponding to the personal air-conditioning unit E which generates the instruction of heating operation mode passes through the flow control valve 41 corresponding to the personal air-conditioning unit E which generates the request of cooling operation mode and then flows into the indoor heat exchanger 45 of the personal air-conditioning unit E which generates the request of cooling operation mode. In the indoor heat exchanger 45, the refrigerant evaporates. Thus, the space around the desk 7 is separately cooled.

The refrigerant passing through the indoor heat exchanger 45 passes through the evaporative pressure regulator 46, two-way valve 47 (indicated by white)

and accumulator 27 and then is drawn into the compressor 21.

When the heating operation mode is determined, the relative humidity of the internal air is low and there is no possibility that dew is deposited.

In the above embodiment, the evaporative pressure regulator 46 is disposed in the personal air-conditioning unit E, but it can be disposed in the flow dividing unit D.

Figure 16:
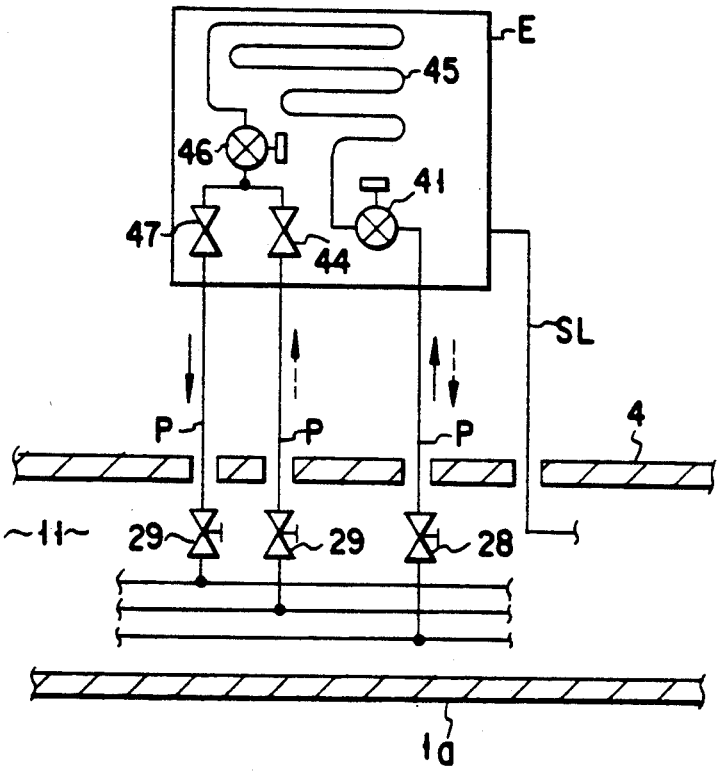
FIG. 16 is a diagram showing the connection of a refrigerant pipe between a personal air-conditioning unit E and a flow dividing unit D in the second embodiment.

All of the parts of the flow dividing unit D ma be incorporated into the personal air-conditioning unit E as shown in FIG. 16. In this case, even if the free access floor 11 is extremely small, it becomes possible to use the flow dividing unit.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air conditioning apparatus having an ambient air-conditioning unit and a plurality of personal air-conditioning units connected to an outdoor unit, comprising:

a compressor provided in said outdoor unit, for drawing in, compressing and discharging refrigerant;

an outdoor heat exchanger provided in said outdoor unit, for exchanging the heat of received refrigerant with the heat of external air;

an indoor heat exchanger provided in said ambient air-conditioning unit, for exchanging the heat of received refrigerant with the heat of internal air;

a plurality of indoor heat exchangers respectively provided in said personal air-conditioning units, for exchanging the heat of received refrigerant with the heat of internal air;

first means for transferring the refrigerant discharged from said compressor into said outdoor heat exchanger, then into said indoor heat exchanger of said ambient air-conditioning unit and then returning the refrigerant to said compressor, said ambient air-conditioning unit cooling a room;

second means for transferring the refrigerant discharged from said compressor into said outdoor heat exchanger, then into said indoor heat exchangers of said personal air-conditioning units and then returning the refrigerant to said compressor, said personal air-conditioning units each partially cooling discrete spaces in the room; and means for causing said indoor heat exchanger of said ambient air-conditioning unit to effect the sensible heat load and the latent heat load and for causing said indoor heat exchangers of said personal air-conditioning units to effect only the sensible heat load.

2. An air conditioning apparatus according to claim 1, wherein said ambient air-conditioning unit is disposed on the upper side of a ceiling of the room.

3. An air conditioning apparatus according to claim 1, wherein said personal air-conditioning units are disposed on the floor of the room.

4. An air conditioning apparatus according to claim 3, further comprising a refrigerant pipe disposed below the floor of the room, for connecting said outdoor unit to said personal air-conditioning units.

5. An air conditioning apparatus according to claim 4, wherein refrigerant pipes for said persona air-conditioning units can be freely connected to or disconnected from said refrigerant pipe disposed below the floor of the room.

6. An air conditioning apparatus according to claim 1, wherein the operation of said ambient air-conditioning unit is started when the operation of at least one of said personal air-conditioning units is started.

7. An air conditioning apparatus for a room having an ambient air-conditioning unit and a plurality of personal air-conditioning units connected to an outdoor unit comprising:

a first indoor heat exchanger provided in said ambient air-conditioning unit, said first heat exchanger cooling air in said room and removing a predetermined amount of moisture from said room; and a second heat exchanger provided in each of said plurality of personal air-conditioners, said second heat exchanger cooling air in said room predetermined locations, said second heat exchanger maintaining a temperature above a calculated room dew point.

8. The air conditioning apparatus of claim 7, wherein a personal air-conditioner is located on the floor of the room.

9. The air conditioning apparatus of claim 7, further comprising a first refrigerant pipe disclosed in the floor of the room, said first refrigerant pipe connecting said outdoor unit to said personal air-conditioning units.

10. The air conditioning apparatus of claim 7, further comprising a second refrigerant pipe disclosed in the ceiling of the room, said second refrigerant pipe connecting said outdoor unit to said ambient air-conditioning units.

11. The air conditioning apparatus of claim 7, further comprising means for separately controlling each said personal air-conditioning unit.

12. The air conditioning apparatus of claim 7, further comprising means for remotely controlling each said personal air-conditioning unit.

13. The air conditioning apparatus of claim 7, wherein a personal air-conditioning unit is in the shape of a desk.

14. The air conditioning apparatus of claim 7, wherein the ambient air-conditioning unit communicates with the personal air-conditioning units, said ambient air-conditioner operates when at least one personal air-conditioner is operating, and said ambient air-conditioner lowers the dew point of said room.

* * * * *